US006780091B2

(12) United States Patent
Mizomoto et al.

(10) Patent No.: US 6,780,091 B2
(45) Date of Patent: Aug. 24, 2004

(54) MACHINING STRAIN REMOVAL APPARATUS

(75) Inventors: Yasutaka Mizomoto, Tokyo (JP); Satoshi Yamanaka, Tokyo (JP); Yoshisato Doi, Tokyo (JP); Takashi Mori, Tokyo (JP); Takashi Kouda, Tokyo (JP)

(73) Assignee: Disco Corporation, Tokyo (JP)

( * ) Notice: Subject to any disclaimer, the term of this patent is extended or adjusted under 35 U.S.C. 154(b) by 43 days.

(21) Appl. No.: 10/217,608

(22) Filed: Aug. 14, 2002

(65) Prior Publication Data

US 2003/0036343 A1 Feb. 20, 2003

(30) Foreign Application Priority Data

Aug. 17, 2001 (JP) ..... 2001-247917

(51) Int. Cl.[7] ..... B24B 7/00
(52) U.S. Cl. ..... 451/67; 451/65; 451/285
(58) Field of Search ..... 451/67, 41, 59, 451/285–289, 65, 56

(56) References Cited

U.S. PATENT DOCUMENTS

| | | | | | |
|---|---|---|---|---|---|
| 4,129,966 | A | * | 12/1978 | Smart et al. | 451/359 |
| 4,216,630 | A | * | 8/1980 | Smart et al. | 451/359 |
| 6,475,070 | B1 | * | 11/2002 | White | 451/59 |
| 6,517,420 | B2 | * | 2/2003 | Ishikawa et al. | 451/67 |
| 6,616,512 | B2 | * | 9/2003 | Sotozaki | 451/54 |
| 2001/0019937 | A1 | * | 9/2001 | Elledge | 451/56 |

* cited by examiner

*Primary Examiner*—Lee D. Wilson
(74) *Attorney, Agent, or Firm*—Smith, Gambrell & Russell, LLP

(57) ABSTRACT

A machining strain removal apparatus for removing machining strain present on a treated surface of a workpiece, for example, a ground back of a semiconductor wafer by polishing the treated surface or ground back with a polishing tool with a high efficiency in a high quality. The apparatus includes a chuck for holding the workpiece while exposing the treated surface, and a polishing component for polishing the treated surface of the workpiece held on the chuck. The polishing component includes a polishing tool, and presses the polishing tool being rotated against the treated surface of the workpiece, thereby polishing the treated surface.

6 Claims, 4 Drawing Sheets

MACHINING STRAIN REMOVAL APPARATUS

FIELD OF THE INVENTION

This invention relates to a machining strain removal apparatus for removing machining strain present on a treated surface of a workpiece by polishing the treated surface. More particularly, the invention relates to, but is not limited to, a machining strain removal apparatus suitable for removing machining strain from the back of a semiconductor wafer, which has many circuits formed on the face thereof, by polishing the back of the semiconductor wafer, the machining strain having been generated by grinding.

DESCRIPTION OF THE PRIOR ART

In a process for production of a semiconductor chip, many rectangular regions are demarcated by streets arranged in a lattice pattern on the face of a semiconductor wafer, and a semiconductor circuit is disposed in each of the rectangular regions. Then, the semiconductor wafer is divided along the streets to form the respective rectangular regions into semiconductor chips. To achieve the compactness and light weight of the semiconductor chips, it is common practice to grind the back of the semiconductor wafer, thereby decreasing the thickness of the semiconductor wafer, before cutting the semiconductor wafer along the streets to separate the rectangular regions individually. In an alternative mode, called the dicing-before-grinding mode, the face of a semiconductor wafer is cut along streets to form grooves of a predetermined depth, and then the back of the semiconductor wafer is ground to a depth exceeding the bottom of the grooves, thereby reducing the thickness of the semiconductor wafer and also separating the rectangular regions individually. Grinding is generally carried out by applying to the back of the semiconductor wafer a rotary grinding tool having a grinding member or grinding wheel formed by binding diamond abrasive grains with a suitable bond such as resin bond.

When the back of the semiconductor wafer is ground, however, machining strain is caused to the back of the semiconductor wafer, and considerably decreases the bending strength of the semiconductor wafer. To remove machining strain from the back of the semiconductor wafer and avoid the decrease in the bending strength, it has been proposed to polish the ground back of the semiconductor wafer with the use of free abrasive grains; to chemically etch the ground back of the semiconductor wafer with the use of an etching solution containing nitric acid and hydrofluoric acid; or to apply a plasma onto the ground back of the semiconductor wafer, thereby etching the back of the semiconductor wafer physically.

The polishing using the free abrasive grains poses the problems that tiresome procedures are necessary for the supply and recovery of the free abrasive grains, resulting in a low efficiency of polishing, and that the free abrasive grains used in large amounts have to be disposed of as an industrial waste. The chemical etching and the physical etching present the problems that considerably expensive equipment is needed, and that it is difficult to apply sufficiently uniform etching.

As disclosed in Japanese Patent Application No. 2001-93397 (Title of the Invention "Polishing Tool") filed by the present applicant, it has been found that machining strain can be removed effectively by polishing the back of a semiconductor wafer with the use of a polishing tool, especially, a polishing tool having a polishing member composed of felt and abrasive grains dispersed in the felt. Polishing, which uses such a polishing tool, is free from the occurrence of a large amount of a waste which has to be disposed of as an industrial waste.

SUMMARY OF THE INVENTION

A principal object of the present invention is to provide a novel and excellent machining strain removal apparatus which can remove machining strain present on a treated surface of a workpiece, for example, a ground back of a semiconductor wafer by polishing the treated surface or ground back with a polishing tool with a high efficiency in a high quality.

According to the present invention, there is provided, as a machining strain removal apparatus for attaining the above principal object, a machining strain removal apparatus for removing machining strain present on a treated surface of a workpiece by polishing the treated surface, comprising:

chuck means for holding the workpiece while exposing the treated surface;

workpiece admission/delivery means for admitting the workpiece, in which the machining strain should be removed from the treated surface, onto the chuck means and delivering the workpiece, in which the machining strain has been removed from the treated surface, from a position on the chuck means; and polishing means for polishing the treated surface of the workpiece held on the chuck means, and wherein the chuck means is selectively positioned in a workpiece admission/delivery area and a polishing area, and when the chuck means is located in the workpiece admission/delivery area, the workpiece having the machining strain to be removed from the treated surface is admitted onto the chuck means, then the chuck means is moved to the polishing area, and the treated surface of the workpiece held on the chuck means is polished by the polishing means to have the machining strain removed from the treated surface, whereafter the chuck means is returned to the workpiece admission/delivery area, and the workpiece is delivered from the position on the chuck means; and the polishing means includes a rotating shaft and a polishing tool mounted on the rotating shaft, and the polishing tool being rotated is pressed against the treated surface of the workpiece, whereby the treated surface is polished.

In a preferred embodiment, the workpiece is a semiconductor wafer having many circuits formed on a face thereof, and the treated surface is a ground back of the semiconductor wafer. The polishing tool preferably has a polishing member composed of felt and abrasive grains dispersed in the felt. The polishing tool may have a support member having a circular support surface, and the polishing member may be in the shape of a disk bonded to the circular support surface of the support member. Preferably, the machining strain removal apparatus further comprises dressing means for dressing the polishing member by jetting a high pressure gas at the polishing member, and cooling means for jetting a cooling gas at the polishing tool and/or the workpiece in the polishing area. It is preferred that when the treated surface of the workpiece is polished by the polishing means, the chuck means is rotated about a central axis of rotation extending parallel to the rotating shaft of the polishing means, and is also reciprocated in directions substantially perpendicular to the rotating shaft of the polishing means.

Advantageously, the chuck means is movable along a straight path extending in the directions substantially perpendicular to the rotating shaft, and a movement of the chuck means when selectively positioned in the workpiece admission/delivery area and the polishing area and a reciprocating movement of the chuck means during polishing of the treated surface of the workpiece by the polishing means are both along the straight path. Preferably, a dust cover is disposed for surrounding the chuck means located in the polishing area, the workpiece held on the chuck means, and the polishing tool pressed against the treated surface of the workpiece, an opening is formed in the dust cover so as to allow the chuck means and the workpiece held on the chuck means to pass through the opening when the chuck means moves from the workpiece admission/delivery area to the polishing area and when the chuck means moves from the polishing area to the workpiece admission/delivery area, and an exhaust duct for exhausting an interior of the dust cover is connected to the dust cover. Also preferably, the rotating shaft of the polishing means is movable in a direction of a central axis thereof, and an opening is formed in the dust cover so as to allow the polishing tool to pass through the opening when the polishing tool is moved toward and away from the workpiece held on the chuck means by movement of the rotating shaft in the direction of the central axis thereof. It is preferred that the chuck means includes a chuck plate formed from a porous material and having a substantially flat surface, the workpiece is attracted onto the chuck plate, and chuck plate cleaning means is disposed for cleaning the chuck plate. It is also preferred that the chuck plate cleaning means includes a cleaning brush and an oil stone, and the cleaning brush and the oil stone are each pressed against the surface of the chuck plate and are each also rotated about a central axis of rotation extending substantially perpendicularly to the surface of the chuck plate and reciprocated in directions substantially parallel to the surface of the chuck plate.

DETAILED DESCRIPTION OF THE PREFERRED EMBODIMENTS

Preferred embodiments of a machining strain removal apparatus constructed according to the present invention will now be described in detail by reference to the accompanying drawings.

Figure 1:
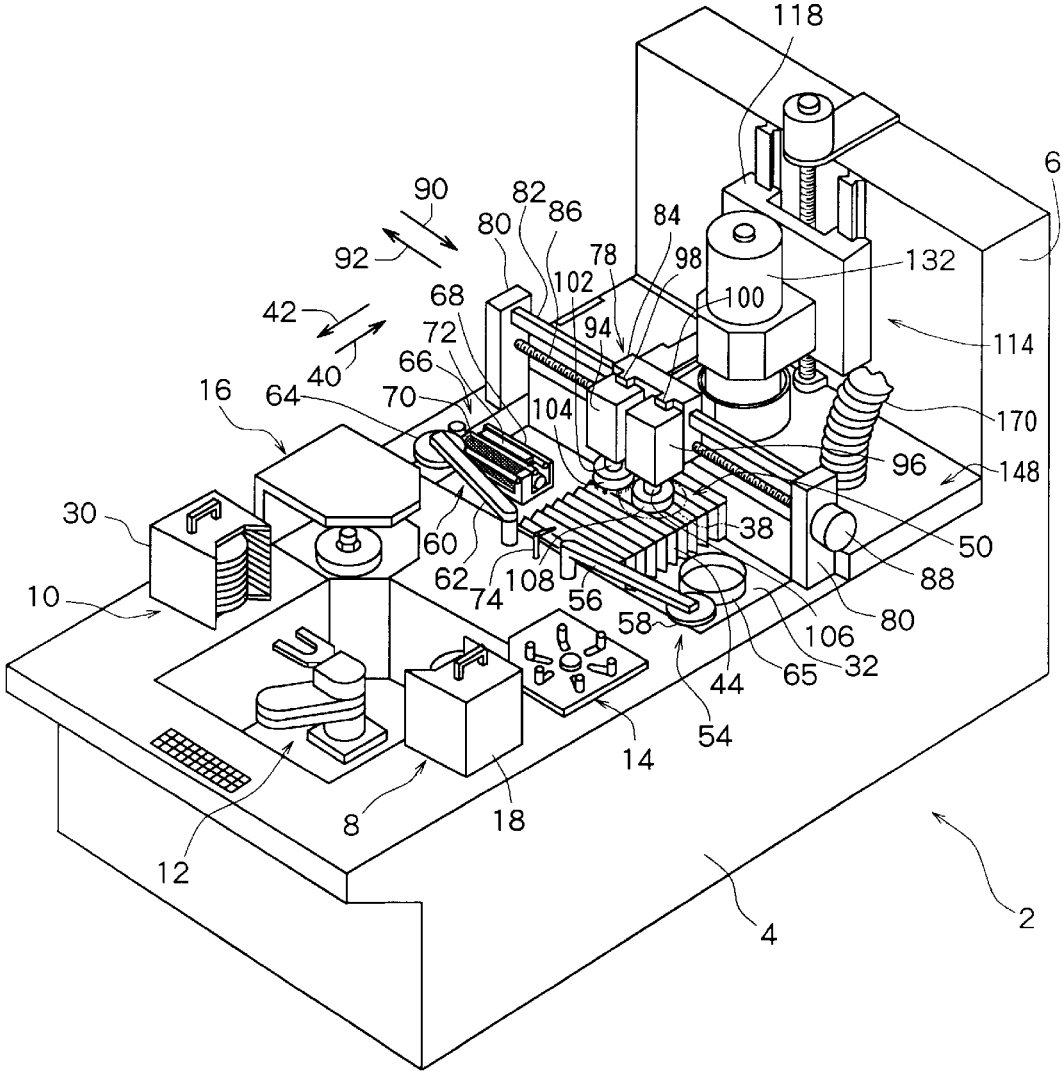
FIG. 1 is a perspective view showing a preferred embodiment of a machining strain removal apparatus constructed according to the present invention.

FIG. 1 shows a preferred embodiment of a machining strain removal apparatus constructed according to the present invention. The illustrated machining strain removal apparatus has a housing entirely indicated at the numeral 2. The housing 2 has a main portion 4 of a rectangular parallelopipedal shape extending in an elongated manner. An upright wall 6 extending upwardly in a substantially vertical direction is disposed at a rear end of the main portion 4. A cassette admission area 8, a cassette delivery area 10, a transport mechanism 12, temporary reception means 14, and cleaning means 16 are disposed on a front half of the main portion 4 of the housing 2. A cassette 18 accommodating a plurality of workpieces is manually placed on the cassette admission area 8.

Figure 2:
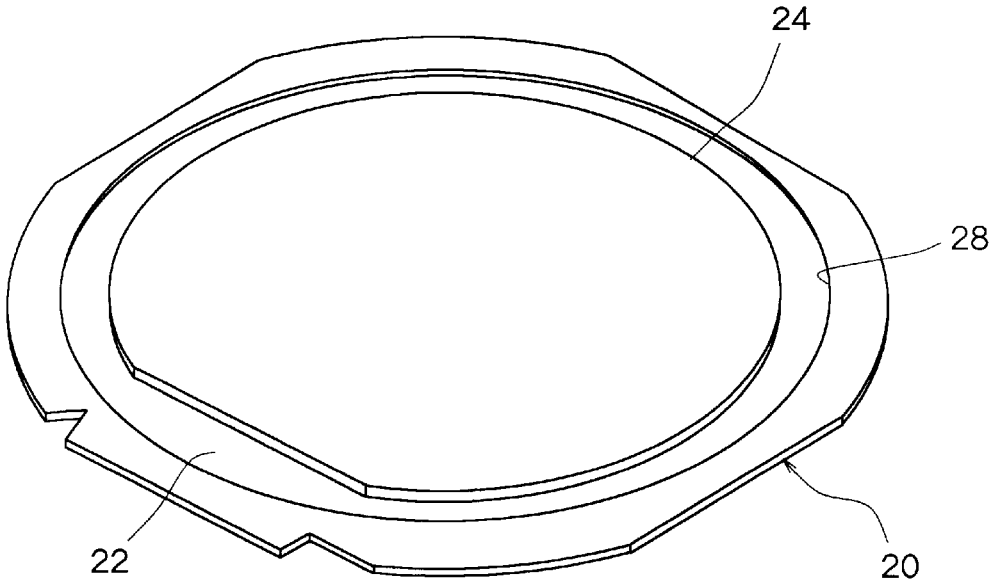
FIG. 2 is a perspective view showing a state in which a semiconductor wafer, a typical example of a workpiece having a treated surface with residual machining strain, is mounted on a frame via a mounting tape.
Figure 3:
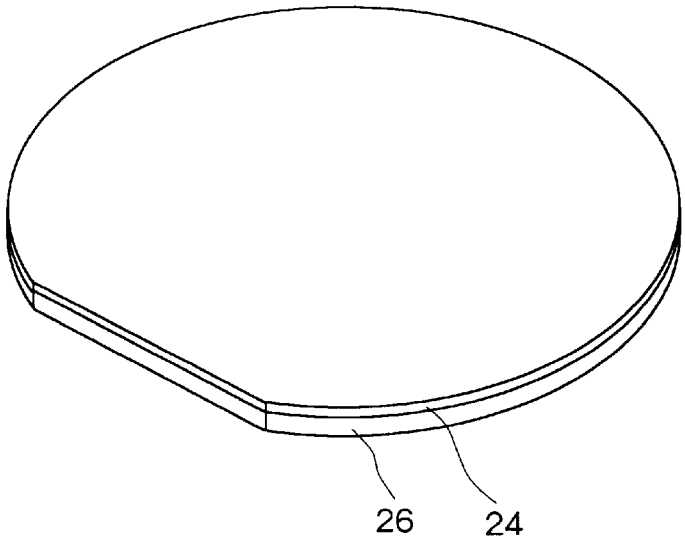
FIG. 3 is a perspective view showing a state in which a semiconductor wafer, a typical example of a workpiece having a treated surface with residual machining strain, is mounted on a support substrate.

The workpiece accommodated in the cassette 18 may be a semiconductor wafer 24 mounted on a frame 20 via a mounting tape 22 as shown in FIG. 2, or a semiconductor wafer 24 mounted on a support substrate 26 as shown in FIG. 3. In FIG. 2, a mounting opening 20 is formed in the center of the frame 20 which can be formed from a suitable metal plate or a suitable plastic material. The semiconductor water 24 is located, in an upside-down state, i.e., with its back directed upwards, in the mounting opening 28 of the frame 20. The mounting tape 22 is bonded so as to spread between the lower surface of the frame 20 and the face or lower surface of the semiconductor wafer 24, whereby the semiconductor wafer 24 is mounted on the frame 20. In FIG. 3, the semiconductor wafer 24 is bonded, in an upside-down state, i.e., with its back directed upwards, onto the support substrate 26 which can be formed from glass or ceramics. The contour of the support substrate 26 may be substantially the same as the contour of the semiconductor wafer 24. Bonding of the mounting tape 22 and the semiconductor wafer 24, and bonding of the support substrate 26 and the semiconductor wafer 24 are performed advantageously via a well-known adhesive whose bonding action is eliminated by heating or ultraviolet radiation during stripping to be performed later. Many rectangular regions are defined on the face of the semiconductor wafer 24 by streets (not shown) arranged in a lattice pattern, and a semiconductor circuit (not shown) is formed in each of the rectangular regions. To decrease the thickness of the semiconductor wafer 24, the upwardly directed back of the semiconductor wafer 24 has been subjected to grinding. Because of this grinding, machining strain remains in the back of the semiconductor wafer 24.

In the cassette delivery area 10, a cassette 30 for accommodating a workpiece (i.e., semiconductor wafer 24) having a back polished in a later-described manner is placed (the cassette 30 may be substantially the same as the cassette 18). The transport mechanism 12 brings the semiconductors 24, one by one, out of the cassette 18 onto the temporary reception means 14. The semiconductor wafer 24 brought onto the temporary reception means 14 has its back polished in the later-described manner to have machining strain removed, and is then transported to the cleaning means 16. In the cleaning means 16, cleaning water, which may be pure water, is jetted at the back of the semiconductor wafer 24, with the semiconductor wafer 24 being rotated at a high speed. Thus, the back of the semiconductor wafer 24 is cleaned and dried. Then, the semiconductor wafer 24 on the cleaning means 16 is carried into the cassette 30. After the semiconductor wafers 24 accommodated in the cassette 18 on the cassette admission area 8 are all withdrawn, a new cassette 18 accommodating a plurality of semiconductor wafers 24 is placed manually on the cassette admission area 8 instead of the empty cassette 18. When a required number of the semiconductor wafers 24 are carried into the cassette 30 on the cassette delivery area 10, the cassette 30 is manually delivered, and a new empty cassette is set in place.

The above-described constitution in the illustrated machining strain removal apparatus, comprising the cassette admission area 8, cassette delivery area 10, transport mechanism 12, temporary reception means 14, and cleaning means 16, may be substantially the same as, for example, the constitution used in the grinder sold by Disco Corporation, Japan, under the trade name of "DFG841". Thus, detailed descriptions of these constituents are omitted herein.

Figure 4:
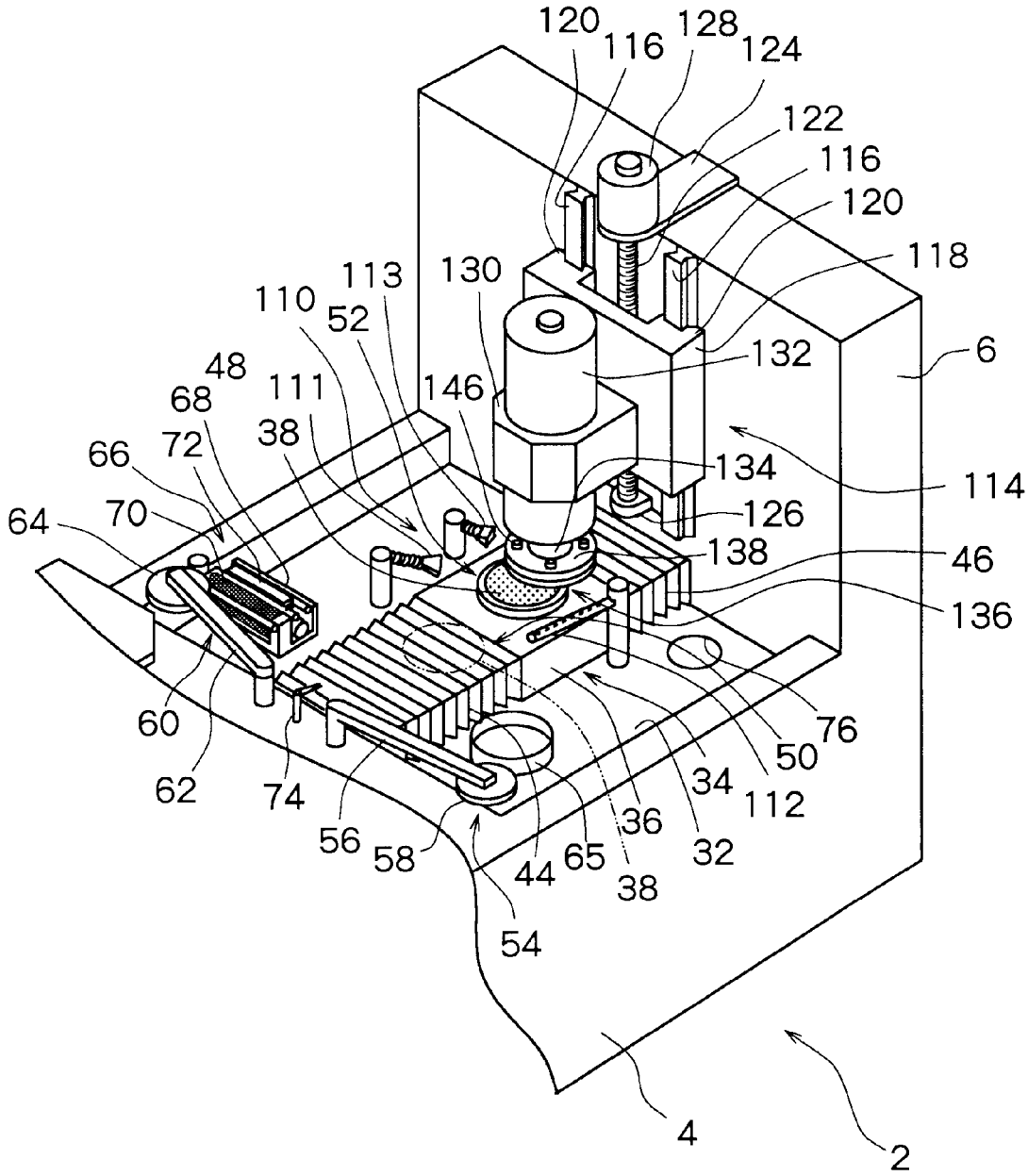
FIG. 4 is a perspective view showing a state in which a main portion of the machining strain removal apparatus shown in FIG. 1 is not covered with a dust cover.

With reference to FIG. 4 along with FIG. 1, a depressed portion 32 of a nearly rectangular shape is formed in a rear half of the main portion 4 of the housing 2, and chuck means 34 is mounted in the depressed portion 32. The chuck means 34 includes a support member 36, and a disk-shaped chuck plate 38 mounted on the support member 36 so as to be rotatable about a central axis of rotation extending substantially vertically. An electric motor (not shown) for rotating the chuck plate 38 is disposed in the support member. Advantageously, the chuck plate 38 is composed of a suitable porous material such as a porous ceramic. A pair of guide rails (not shown), which extend in directions shown by arrows 40 and 42 substantially horizontal to the direction of extension of the housing 4 (accordingly, substantially perpendicular to a rotating shaft of polishing means to be described later), are disposed on the depressed portion 32. The support member 36 of the chuck means 34 is slidably mounted on the pair of guide rails. A threaded shaft (not shown) extending in the directions indicated by the arrows 40 and 42 is further mounted rotatably on the depressed portion 32. An internally threaded through-hole (not shown) extending in the directions shown by the arrows 40 and 42 is formed in the support member 36 of the chuck means 34, and the threaded shaft is screwed into the internally threaded hole. An output shaft of an electric motor (not shown), which may be a pulse motor, is connected to the threaded shaft. When the electric motor is rotated in the normal direction, the chuck means 34 is moved in the direction indicated by the arrow 40. When the electric motor is rotated in the reverse direction, the chuck means 34 is moved in the direction indicated by the arrow 42. Bellows means 44 and 46, which have an inverted-channel cross-sectional shape and cover the threaded shaft, etc., are provided on both sides of the chuck means 34 in its direction of movement. The bellows means 44 and 46 can be formed from a suitable material such as canvas. The front end of the bellows means 44 is fixed to the front surface wall of the depressed portion 34, while the rear end of the bellows means 44 is fixed to the front end surface of the support member 36 of the chuck means 34. The front end of the bellows means 46 is fixed to the rear end surface of the support member 36 of the chuck means 34, while the rear end of the bellows means 46 is fixed to the front surface of the upright wall 6 of the housing 2. When the chuck means 34 is moved in the direction indicated by the arrow 40, the bellows means 44 is expanded, while the bellows means 46 is contracted. When the chuck means 34 is moved in the direction indicated by the arrow 42, the bellows means 44 is contracted, while the bellows means 46 is expanded. The chuck means 34 moved along a straight path extending in the directions indicated by the arrows 40 and 42, as will be described in detail later, is selectively positioned in a workpiece admission/delivery area 50 and a polishing area 52 which are located with spacing in the directions indicated by the arrows 40 and 42. (As will be further mentioned later, the chuck means 34 is further moved back and forth in the directions indicated by the arrows 40 and 42 over a predetermined range in the workpiece admission/delivery area 50 and the polishing area 52.) The chuck plate 38 of the chuck means 34 is selectively brought into communication with a vacuum source via a communication passage (not shown) disposed in the support member 36 and the housing 4, thereby vacuum attracting the workpiece, i.e., semiconductor wafer 24, to be polished as will be stated later.

Workpiece admission means 54 is disposed on one side of an intermediate section of the main portion 4 of the housing 2. The workpiece admission means 54 is designed to bring the workpiece, i.e., semiconductor wafer 24, placed on the temporary reception means 14 onto the chuck plate 38 when the chuck means 34 is located in the workpiece admission/delivery area 50. The admission means 54 is composed of a moving arm 56 having a vertical portion extending substantially vertically, and a horizontal portion extending from the vertical portion substantially horizontally, and an attraction implement 58 mounted at the front end of the moving arm 56. The vertical portion of the moving arm 56 is mounted so as to be movable upward and downward and rotatable about a central axis extending substantially vertically. A porous member is disposed on the lower surface of the attraction implement 58. The attraction implement 58 is selectively brought into communication with a vacuum source (not shown) through a communication passage (not shown) disposed in the moving arm 56 and the main portion 4 of the housing 2, whereby the semiconductor wafer 24 is attracted to the lower surface of the attraction implement 58. In accordance with the upward or downward movement and rotation of the moving arm 56, the semiconductor wafer 24 is transported to a required position. Workpiece delivery means 60 is disposed on the other side of the intermediate section of the main portion of the housing 2. The workpiece delivery means 60 is designed to deliver the semiconductor wafer 24 on the chuck plate 38 to the cleaning means 16 when the chuck means 34 is located in the workpiece admission/delivery area 50. The delivery means 60 is also composed of a moving arm 62 having a vertical portion extending substantially vertically, and a horizontal portion extending from the vertical portion substantially horizontally, and an attraction implement 64 mounted at the front end of the moving arm 62. The vertical portion of the moving arm 62 is mounted so as to be movable upward and downward and rotatable about a central axis extending substantially vertically. A porous member is disposed on the lower surface of the attraction implement 64. The attraction implement 64 is selectively brought into communication with a vacuum source (not shown) through a communication passage (not shown) disposed in the moving arm 62 and the main portion 4 of the housing 2, whereby the semiconductor wafer 24 is attracted to the lower surface of the attraction implement 64. In accordance with the upward or downward movement and rotation of the moving arm 62, the semiconductor wafer 24 is transported to a required position.

On one side of the depressed portion 32, a cleaning pool 65 is disposed in association with the workpiece admission means 54. A cleaning fluid, which may be pure water, is circulated in the cleaning pool 65. Before admitting the workpiece, i.e., semiconductor wafer 24, attracted to the attraction implement 58 onto the chuck means 38, the workpiece admission means 54 dips the lower surfaces of the frame 20 and mounting tape 22 or the lower surface of the support substrate 26, on which the semiconductor wafer 24 has been mounted, into the cleaning fluid within the cleaning pool 65 to release dust or swarf, if the dust or swarf adheres to the lower surface(s).

The attraction implement 58 of the workpiece admission means 54 is brought into contact with the back of the semiconductor wafer 24 before being polished, to attract the semiconductor wafer 24. Thus, the porous member disposed on the lower surface of the attraction implement 58 is not contaminated. Whereas the attraction implement 64 of the workpiece delivery means 60 is brought into contact with the back of the semiconductor wafer 24 after polishing, to attract the semiconductor wafer 24. Thus, the porous member disposed on the lower surface of the attraction implement 64 is contaminated with polishing swarf. In the illustrated embodiment, therefore, attraction implement cleaning means 66 for cleaning, where necessary, the lower surface of the attraction implement 64 of the workpiece delivery means 60 is disposed on the other side of the main portion 4 of the housing 2. The attraction implement cleaning means 66 is composed of a support frame 68 fixed onto the depressed portion 32 formed in the main portion 4 of the housing 2, and a brush member 70 and an oil stone 72 disposed parallel on the support frame 68. The brush member 70 in the shape of a cylinder extending substantially horizontally is rotated about its central axis. Many fibers, which may be synthetic fibers, are disposed on the circumferential surface of the brush member 70. The oil stone 72, which may be shaped like a plate, is moved back and forth in a substantially horizontal direction. In cleaning the lower surface of the attraction implement 64, the brush member 70 is rotated, the oil stone 72 is moved back and forth, and the attraction implement 64 is pivoted in a reciprocating manner over a predetermined range, with the lower surface of the attraction implement 64 being pressed against the brush member 70 and/or the oil stone 72. The brush member 70 brushes polishing swarf off the porous member, while the oil stone 72 grinds the surface of the porous member to discharge polishing swarf, which has infiltrated into the porous member, and to flatten the surface of the porous member.

In the illustrated embodiment, cleaning fluid jetting means 74 is also disposed in the intermediate section of the main portion 4 of the housing 2. The cleaning fluid jetting means 74 jets a cleaning fluid, which may be pure water, at a site on the chuck means 34 when cleaning the chuck plate 38 by chuck plate cleaning means to be described later. As shown in FIG. 4, a drainage port 76 for guiding the cleaning fluid, which has been jetted from the cleaning fluid jetting means 74, to a drainage hose (not shown) is formed in the depressed portion 32 formed in the main portion 4 of the housing 2.

As shown in FIG. 1, chuck plate cleaning means 78 is disposed on the main portion 4 of the housing 2 in association with the workpiece admission/delivery area 50 where the chuck means 34 is selectively located. In detail, upright support members 80 extending upwards are disposed at opposite side edges of the main portion 4 of the housing 2, and a guide rod 82 extending substantially horizontally is fixed between the support members 80. A slide block 84 is mounted on the guide rod 82. A through-hole, through which the guide rod 82 is inserted, is formed in the slide block 84, and the slide block 84 is slidable along the guide rod 82. A threaded shaft 86, which extends substantially horizontally below the guide rod 82, is rotatably mounted between the support members 80. The threaded shaft 86 is screwed through an internally-threaded through-hole formed in the slide block 84. An electric motor 88 is mounted on one of the support members 80, and an output shaft of the motor 88 is connected to the threaded shaft 86. When the motor 88 is rotated in the normal direction to rotate the threaded shaft 86 in a predetermined direction, the slide block 84 is moved in a direction indicated by an arrow 90. When the motor 88 is rotated in the reverse direction to rotate the threaded shaft 86 in the reverse direction, the slide block 84 is moved in a direction indicated by an arrow 92. Cases 94 and 96 are mounted on the front surface of the slide block 84. Guide rails 98 and 100 extending substantially vertically are formed on the front surface of the slide block 84. Guided grooves extending substantially vertically are formed on the rear surfaces of the cases 94 and 96. By bringing the guided grooves of the cases 94 and 96 into engagement with the guide rails 98 and 100, the cases 94 and 96 are mounted on the front surface of the slide block 84 so as to be movable upward and downward. Elevating means (not shown), which may be pneumatic cylinder mechanisms, are interposed between the slide block 84 and each of the cases 94 and 96. The cases 94 and 96 are raised and lowered by the elevating means. An electric motor is mounted in the case 94, and its output shaft 102 is extended downward beyond the case 94. The output shaft 102 extends substantially vertically (accordingly, substantially perpendicularly to the surface of the chuck plate 38), and a brush member 104 is fixed to the lower end of the output shaft 102. The brush member 104 is composed of a disk-shaped base portion, and many fibers, optionally synthetic fibers, planted on the lower surface of the base portion. An electric motor is mounted in the case 96 as well, and its output shaft 106 is extended downward beyond the case 96. The output shaft 106 extends substantially vertically (accordingly, substantially perpendicularly to the surface of the-chuck plate 38), and a disk-shaped oil stone 108 is fixed to the lower end of the output shaft 106.

As will be further mentioned later, when the workpiece is to be admitted onto the chuck means 34 located in the workpiece admission/delivery area 50, and when the workpiece is to be delivered from the position on the chuck means 34, the cases 94 and 96 are raised to a non-operating position, and the slide block 84 is retreated to one side of the main portion 4 of the housing 2. On the other hand, when the chuck plate 38 of the chuck means 34 is to be cleaned, where necessary, after delivery of the polished workpiece from the position on the chuck means 34, the slide block 84 is moved to the center of the main portion 4 of the housing 2 and positioned opposite the chuck plate 38 of the chuck means 34. Then, the brush member 104 and the oil stone 108 are rotationally driven, and the cases 94 and 96 are lowered to an operating position, whereby the rotationally driven brush member 104 and oil stone 108 are pressed against the surface of the chuck plate 38. During this process, the slide block 84 is reciprocated over a predetermined range in the directions indicated by the arrows 90 and 92 (accordingly, in directions parallel to the surface of the chuck plate 38). The chuck means 34 is rotated, and also reciprocated over a predetermined range in the directions indicated by the arrows 40 and 42. Further, a fluid solution is jetted from the cleaning fluid jetting means 74 toward the chuck plate 38. Thus, the brush member 104 acts on the chuck plate 38 formed from the porous material to brush polishing swarf off, while the oil stone 108 grinds the surface of the chuck plate 38 to discharge infiltrating polishing swarf and to flatten the surface of the chuck plate 38.

With reference to FIG. 4, cooling means 110 is disposed in the depressed portion 32, which is formed in the main portion 4 of the housing 2, in association with the polishing area 52 where the chuck means 34 is selectively located. The cooling means 110 in the illustrated embodiment includes first jetting means 111, which jets a cooling gas, optionally air, at the workpiece or semiconductor wafer 24 held on the chuck plate 38 of the chuck means 34 located in the polishing area 52, and second jetting means 113, which jets a cooling gas, optionally air, at a polishing tool (the polishing tool will be described in detail later) applied to the treated surface of the workpiece, i.e., the back of the semiconductor wafer 24, in the polishing area 52. In desired, suitable cooling means, for example, cooling means including a circulation passage where a cooling medium is circulated, may be disposed in the chuck means 34 in addition to, or instead of, the cooling means 110. In the illustrated embodiment, dressing means 112 is disposed in association with the polishing area 52. The dressing means 112 jets a high pressure gas, optionally high pressure air, at a polishing member of the polishing tool (the polishing tool will be described in detail later), exerting a so-called dressing action on the polishing member.

With reference to FIGS. 1 and 4, especially FIG. 4, polishing means 114 is disposed on the upright wall 6 disposed at the rear end of the housing 2. In more detail, a pair of guide rails 116 extending substantially vertically are fixed to the front surface of the upright wall 6. A slide block 118 is mounted on the pair of guide rails 116 vertically slidably. Legs 120 extending substantially vertically are formed on both sides of the rear surface of the slide block 118. Guided grooves formed in the legs 120 are slidably engaged with the pair of guide rails 116. Further, a threaded shaft 122 extending substantially vertically is rotatably mounted on the front surface of the upright wall 6 by bearing members 124 and 126. An electric motor 128, optionally a pulse motor, is mounted on the bearing member 124, and an output shaft of the motor 128 is connected to the threaded shaft 122. A connecting portion (not shown) is formed on the rear surface of the slide block 118 in such a manner as to protrude rearward from the widthwise center of the rear surface. An internally threaded through-hole extending vertically is formed in the connecting portion, and the threaded shaft 122 is screwed through the internally threaded hole. Thus, when the motor 128 is rotated in the normal direction, the slide block 118 is lowered. When the motor 128 is rotated in the reverse direction, the slide block 118 is elevated.

Figure 5:
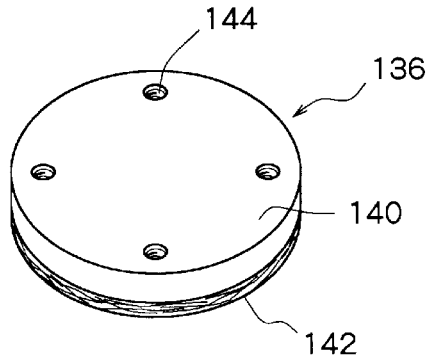
FIG. 5 is a perspective view showing a polishing tool used in the machining strain removal apparatus shown in FIG. 1.
Figure 6:
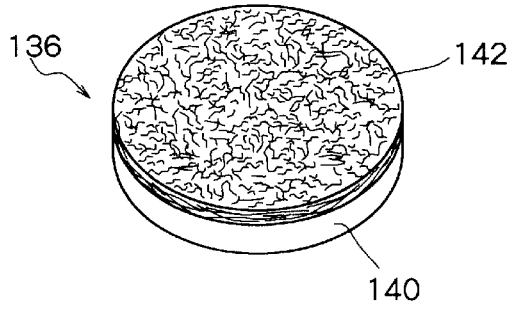
FIG. 6 is a perspective view showing the polishing tool of FIG. 5 as viewed from its lower surface.

A support portion 130 protruding forward is formed on the front surface of the slide block 118, and a case 132 is mounted on the support portion 130. A rotating shaft 134 extending substantially vertically is rotatably mounted in the case 132. An electric motor (not shown) is also disposed in the case 132, and an output shaft of the motor is connected to the rotating shaft 134. A lower end portion of the rotating shaft 134 is protruded downward beyond the lower end of the case 132, and a polishing tool 136 is mounted on the lower end of the rotating shaft 134. In detail, a disk-shaped mounting member 138 is fixed to the lower end of the rotating shaft 134. A plurality of through-holes (not shown) are formed in the mounting member 138 at circumferentially spaced locations. The polishing tool 136, as shown in FIGS. 5 and 6, consists of a disk-shaped support member 140 and a similarly disk-shaped polishing member 142. In the support member 140, a plurality of blind tapped holes 144 extending downward from its upper surface are formed in circumferentially spaced relationship. The lower surface of the support member 140 constitutes a circular support surface, and the polishing member 142 is bonded to the circular support surface of the support member 140 by a suitable adhesive such as an epoxy resin adhesive. The polishing member 142 is preferably composed of felt and many abrasive grains dispersed in the felt. A detailed explanation for the constitution of the polishing member 142 itself is given in the specification and drawings of Japanese Patent Application No. 2001-93397. Thus, the details of the polishing member 142 will be omitted herein, and the description in the specification and drawings should be referred to for the details. The polishing tool 136 is located on the lower surface of the mounting member 138 fixed to the lower end of the rotating shaft 134, and clamping bolts 146 are screwed into the blind tapped holes 144, which are formed in the support member 140 of the polishing tool 136, through the through-holes formed in the mounting member 138. By so doing, the polishing tool 136 is mounted on the mounting member 138.

When the treated surface of the workpiece, namely the back of the semiconductor wafer 24, held on the surface of the chuck plate 38 of the chuck means 34 is to be polished in the polishing area 52, the slide block 118 is lowered, and the polishing member 142 of the rotationally driven polishing tool 136 is pressed against the back of the semiconductor wafer 24. The chuck means 34 is rotated about the central axis of rotation extending substantially vertically (accordingly, extending parallel to the rotating shaft 134 of the polishing means 114), and also moved over a predetermined range in the directions indicated by the arrows 40 and 42. In this manner, the polishing member 142 is caused to act on the back of the semiconductor wafer 24, whereupon the back of the semiconductor wafer 24 is polished to have residual machining strain removed. During this polishing, the cooling gas is jetted from the first jetting means 111 and the second jetting means 113 that constitute the cooling means 110, thus cooling the semiconductor wafer 24 and the polishing member 142. Upon completion of polishing, the slide block 118 is somewhat elevated to separate the polishing member 142 from the back of the semiconductor wafer 24. Then, the high pressure gas is jetted from the dressing means 112 toward the polishing member 142 to eliminate loading or clogging of the polishing member 142.

Figure 7:
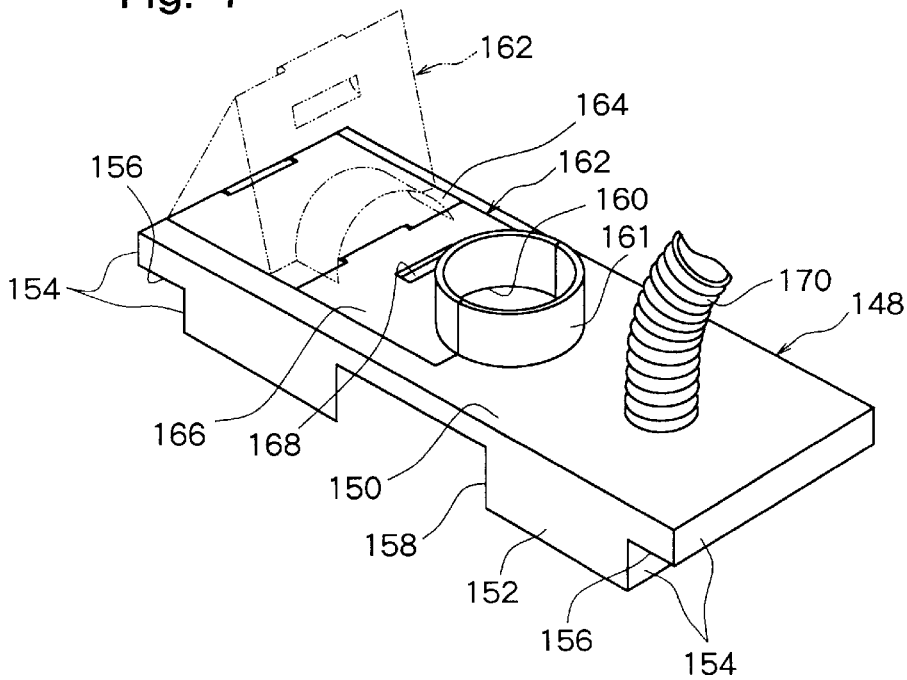
FIG. 7 is a perspective view showing the dust cover used in the machining strain removal apparatus shown in FIG. 1.

FIG. 7 along with FIGS. 1 and 4 will be referred to for further explanation. In the illustrated embodiment, a dust cover 148 is disposed for surrounding the polishing tool 136 pressed against the treated surface of the workpiece, i.e., the back of the semiconductor wafer 24, held on the chuck means 34, as well as the chuck means 34 located in the polishing area 52. The dust cover 148 is box-shaped as a whole, and has an upper wall 150, a front wall 152 and side walls 154. The dust cover 148 has a rear edge in intimate contact with the upright wall 6, and fixed at the position illustrated in FIG. 1. The side walls 154 of the dust cover 148 each have a shoulder surface 156 facing downward in an intermediate part thereof in the up-and-down direction. A lower half of the side wall 154 is brought into intimate contact with each of the side surfaces of the depressed portion 32, and the shoulder surface 156 is brought into intimate contact with the upper surface of each of the side edges of the main portion 4 of the housing 2. A rectangular opening 158 for allowing the passage therethrough of the chuck means 34 is formed in the front wall 152 of the dust cover 148. A circular opening 160 for allowing the passage therethrough of the support member 140 of the polishing means 114 and the polishing tool 136 is formed in the upper wall 150 of the dust cover 148. A part of the upper wall 150 of the dust cover 148 is defined by an openable/closable door 162. The door 162 is composed of a first pivot member 164 having one edge pivotally connected to the upper edge of one side wall 154, and a second pivot member 166 having one edge pivotally connected to the front edge of the first pivot member 164. A semicircular notch defining a half of the circular opening 160 is formed in a free edge of the second pivot member 166. A concave portion 168, on which a finger can be hooked, is also formed on the outer surface of the second pivot member 166. The door 162 is normally located at a closing position indicated by solid lines in FIGS. 1 and 7, but in the case of repair or replacement of the polishing tool 136, can have the concave portion 168 hooked by the finger and thereby brought to an opening position indicated by two-dot chain lines in FIG. 7. A cylindrical member 161 extending upward from the peripheral edge of the circular opening 160 is provided on the upper wall 150 of the dust cover 148. The cylindrical member 161 is composed of two semicylindrical members, one of which is fixed to a main portion of the upper wall 150, and the other of which is fixed to the second pivot member 166 of the door 162 and opened or closed together with the second pivot member 166. An exhaust duct 170 for exhausting the interior of the dust cover 148 is provided on the upper wall 150 of the dust cover 148. The exhaust duct 170 is equipped with suitable exhaust means (not shown), and the polishing area 52 surrounded by the dust cover 148 is exhausted when the back of the semiconductor wafer 24 is polished by the polishing tool 136.

An example of the polishing action by the illustrated machining strain removal apparatus will be explained briefly with reference to FIGS. 1 and 4. When the chuck means 34 is located in the workpiece admission/delivery area 50, the semiconductor wafer 24, whose back having machining strain is to be polished to remove the machining strain, is admitted from the position on the reception means 14 onto the chuck means 34 by the workpiece admission means 54, with the back of the semiconductor wafer 24 being directed upwards. The semiconductor wafer 24 in this state is attracted onto the chuck plate 38. Then, the chuck means 34 is moved to the polishing area 52 in the direction indicated by the arrow 40. In the polishing area 52, the chuck plate 38 holding the semiconductor wafer 24 is rotated, and simultaneously the polishing member 142 of the polishing tool 136 being rotationally driven is pressed against the back of the semiconductor wafer 24 on the chuck plate 38. Also, the chuck means 34 is reciprocated over a predetermined range in the directions indicated by the arrows 40 and 42. Thus, the back of the semiconductor wafer 24 is dry polished by the action of the polishing member 142 to have residual machining strain removed. During this process, cooling gas is jetted at the semiconductor wafer 24 from the first jetting means 111, while cooling gas is jetted at the polishing member 142 from the second jetting means 113. Moreover, the exhaust means provided in the exhaust duct 170 is actuated to exhaust dust within the dust cover 148.

Upon completion of polishing, the polishing tool 136 is separated upwards from the back of the semiconductor wafer 24, and the chuck means 34 is moved to the workpiece admission/delivery area 50 in the direction indicated by the arrow 42. Then, the semiconductor wafer 24 is delivered by the workpiece delivery means 60 from the position on the chuck means 34 to the cleaning means 16. Then, the chuck plate 38 is cleaned with the chuck plate cleaning means 78, where necessary. In further detail, the slide block 84 is moved to the center of the main portion 4 of the housing 2, and positioned opposite the chuck plate 38 of the chuck means 34. The brush member 104 and the oil stone 108 are rotationally driven, and the cases 94 and 96 are lowered to the operating position to press the rotationally driven brush member 104 and oil stone 108 against the surface of the chuck plate 38. The slide block 84 is reciprocated over a predetermined range in the directions indicated by the arrows 90 and 92, and the chuck means 34 is rotated and also reciprocated over a predetermined range in the directions indicated by the arrows 40 and 42. Further, a cleaning fluid is jetted from the cleaning fluid jetting means 74 toward the chuck plate 38. After cleaning of the chuck plate 38 is completed, the cases 94 and 96 are raised to the non-operating position, and the slide block 84 is retreated to one side of the main portion 4 of the housing 2. Then, the next semiconductor wafer 24 located on the reception means 14 is carried onto the chuck means 34 by the workpiece admission means 54. While the chuck plate 38 is being cleaned in the chuck plate cleaning area 50, the attraction implement 64 of the workpiece delivery means 60 can be cleaned with the attraction implement cleaning means 66, where necessary.

The preferred embodiments of the present invention have been described in detail with reference to the accompanying drawings. However, it is to be understood that the present invention is not limited to these embodiments, but various changes and modifications may be made without departing from the spirit and scope of the invention.

What we claim is:

1. A machining strain removal apparatus for removing machining strain present on a treated surface of a workpiece by polishing the treated surface, comprising:

chuck means for holding the workpiece while exposing the treated surface;

workpiece admission/delivery means for admitting the workpiece, in which the machining strain should be removed from the treated surface, onto the chuck means and delivering the workpiece, in which the machining strain has been removed from the treated surface, from a position on the chuck means; and polishing means for polishing the treated surface of the workpiece held on the chuck means, wherein the chuck means is selectively positioned in a workpiece admission/delivery area and a polishing area, and when the chuck means is located in the workpiece admission/delivery area, the workpiece having the machining strain to be removed from the treated surface is admitted onto the chuck means, then the chuck means is moved to the polishing area, and the treated surface of the workpiece held on the chuck means is polished by the polishing means to have the machining strain removed from the treated surface, whereafter the chuck means is returned to the workpiece admission/delivery area, and the workpiece is delivered from the position on the chuck means, wherein the polishing means includes a rotating shaft and a polishing tool mounted on the rotating shaft, and the polishing tool being rotated is pressed against the treated surface of the workpiece, whereby the treated surface is polished, and wherein when the treated surface of the workpiece is polished by the polishing means, the chuck means is rotated about a central axis of rotation extending parallel to the rotating shaft of the polishing means, and is also reciprocated in directions substantially perpendicular to the rotating shaft of the polishing means.

2. The machining strain removal apparatus of claim 1, wherein the chuck means is movable along a straight path extending in the directions substantially perpendicular to the rotating shaft, and a movement of the chuck means when selectively positioned in the workpiece admission/delivery area and the polishing area and a reciprocating movement of the chuck means during polishing of the treated surface of the workpiece by the polishing means are both along the straight path.

3. A machining strain removal apparatus for removing machining strain present on a treated surface of a workpiece by polishing the treated surface, comprising:

chuck means for holding the workpiece while exposing the treated surface;

workpiece admission/delivery means for admitting the workpiece, in which the machining strain should be removed from the treated surface, onto the chuck means and delivering the workpiece, in which the machining strain has been removed from the treated surface, from a position on the chuck means; and polishing means for polishing the treated surface of the workpiece held on the chuck means, wherein the chuck means is selectively positioned in a workpiece admission/delivery area and a polishing area, and when the chuck means is located in the workpiece admission/delivery area, the workpiece having the machining strain to be removed from the treated surface is admitted onto the chuck means, then the chuck means is moved to the polishing area, and the treated surface of the workpiece held on the chuck means is polished by the polishing means to have the machining strain removed from the treated surface, whereafter the chuck means is returned to the workpiece admission/delivery area, and the workpiece is delivered from the position on the chuck means, wherein the polishing means includes a rotating shaft and a polishing tool mounted on the rotating shaft, and the polishing tool being rotated is pressed against the treated surface of the workpiece, whereby the treated surface is polished, and wherein a dust cover is disposed for surrounding the chuck means located in the polishing area, the workpiece held on the chuck means, and the polishing tool pressed against the treated surface of the workpiece, an opening is formed in the dust cover so as to allow the chuck means and the workpiece held on the chuck means to pass through the opening when the chuck means moves from the workpiece admission/delivery area to the polishing area and when the chuck means moves from the polishing area to the workpiece admission/delivery area, and an exhaust duct for exhausting an interior of the dust cover is connected to the dust cover.

4. The machining strain removal apparatus of claim 3, wherein the rotating shaft of the polishing means is movable in a direction of a central axis thereof, and an opening is formed in the dust cover so as to allow the polishing tool to pass through the opening when the polishing tool is moved toward and away from the workpiece held on the chuck means by movement of the rotating shaft in the direction of the central axis thereof.

5. A machining strain removal apparatus for removing machining strain present on a treated surface of a workpiece by polishing the treated surface, comprising:

chuck means for holding the workpiece while exposing the treated surface;

workpiece admission/delivery means for admitting the workpiece, in which the machining strain should be removed from the treated surface, onto the chuck means and delivering the workpiece, in which the machining strain has been removed from the treated surface, from a position on the chuck means; and polishing means for polishing the treated surface of the workpiece held on the chuck means, wherein the chuck means is selectively positioned in a workpiece admission/delivery area and a polishing area, and when the chuck means is located in the workpiece admission/delivery area, the workpiece having the machining strain to be removed from the treated surface is admitted onto the chuck means, then the chuck means is moved to the polishing area, and the treated surface of the workpiece held on the chuck means is polished by the polishing means to have the machining strain removed from the treated surface, whereafter the chuck means is returned to the workpiece admission/delivery area, and the workpiece is delivered from the position on the chuck means, wherein the polishing means includes a rotating shaft and a polishing tool mounted on the rotating shaft, and the polishing tool being rotated is pressed against the treated surface of the workpiece, whereby the treated surface is polished, and wherein the chuck means includes a chuck plate formed from a porous material and having a substantially flat surface, the workpiece is attracted onto the chuck plate, and chuck plate cleaning means is disposed for cleaning the chuck plate.

6. The machining strain removal apparatus of 5, wherein the chuck plate cleaning means includes a cleaning brush and an oil stone, and the cleaning brush and the oil stone are each pressed against the surface of the chuck plate and are each also rotated about a central axis of rotation extending substantially perpendicularly to the surface of the chuck plate and reciprocated in directions substantially parallel to the surface of the chuck plate.

* * * * *